US005339869A

United States Patent [19]

Hayakawa

[11] Patent Number: 5,339,869

[45] Date of Patent: Aug. 23, 1994

[54] STRANDED WIRE BINDER

[76] Inventor: Toshio Hayakawa,
1-go,50-ban,Yamanoue 5-chome,
Hirakata-shi, Osaka-fu, Japan

[21] Appl. No.: 880,846

[22] Filed: May 11, 1992

[30] Foreign Application Priority Data

May 11, 1991 [JP] Japan ..... 3-167356

[51] Int. Cl.[5] ..... B21F 15/04
[52] U.S. Cl. ..... 140/119; 140/57
[58] Field of Search ..... 140/57, 93 A, 93.6, 140/118, 119, 120

[56] References Cited

U.S. PATENT DOCUMENTS 2,289,253 7/1942 Dowd ..... 140/119
4,834,148 5/1989 Muguruma et al. ..... 140/93 A

*Primary Examiner*—Lowell A. Larson
*Attorney, Agent, or Firm*—Edwin E. Greigg; Ronald E. Greigg

[57] ABSTRACT

A stranded wire binder comprising a bit which rotates in engagement with a stranded wire, a motor, a transmission for operatively connecting the motor to the bit, a torque limiter and a position determining mechanism for controlling a stop position of the bit, both being provided with the transmission, and an operation mechanism for releasing a position determining function of the position determining mechanism.

14 Claims, 9 Drawing Sheets

Fig. 3
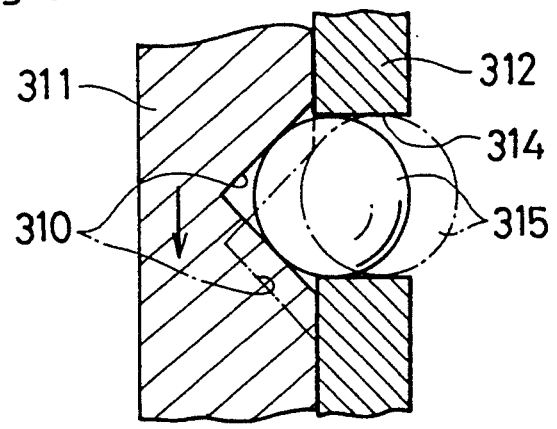
Fig. 4a
Fig. 4b
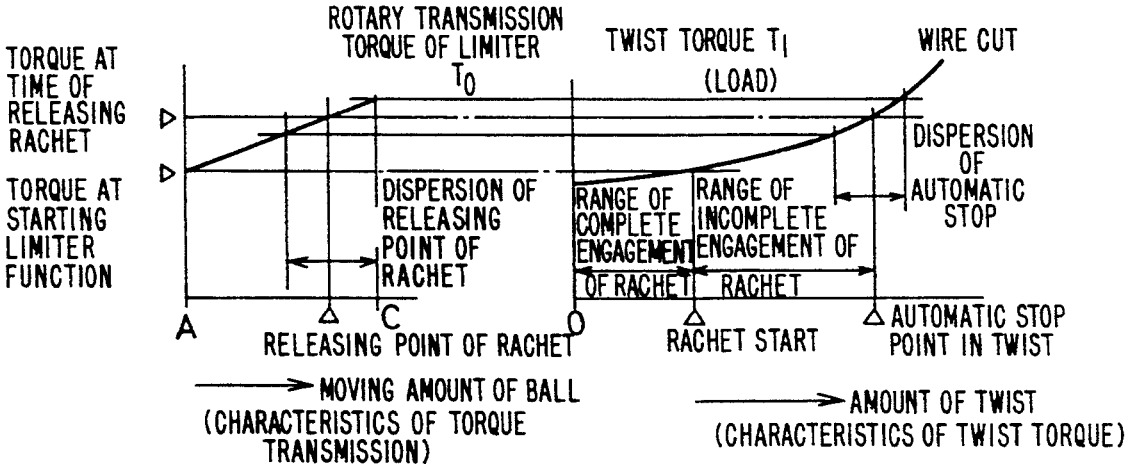
Fig. 5
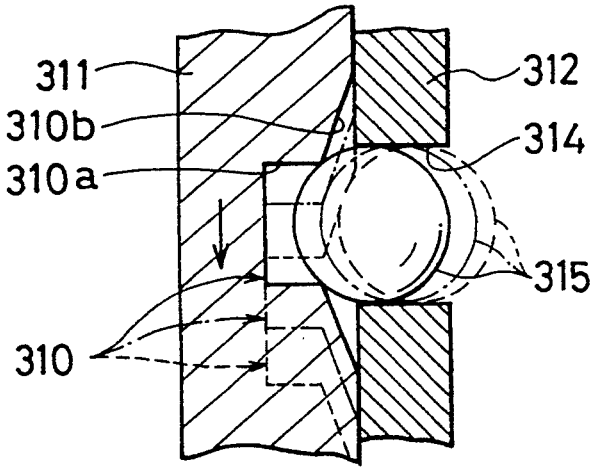

STRANDED WIRE BINDER

BACKGROUND OF THE INVENTION

1 Field of the Invention

The present invention relates to a stranded wire binder.

2 Description of the Prior Art

Conventionally, it is well known to bind a stranded wire in such a situation. For example, reinforcing bars or steel frames for a scaffold are binded by using the stranded wires for temporarily fixing the scaffold at a building site. A thermal insulating material wound on pipes for air conditioning is also fixed temporarily by the stranded wires. A roof is tiled over by using the stranded wires such as copper. A gutter is secured to fixings therefor by means of the stranded wires. Plants are secured to poles posts for gardening by means of the stranded wire. In gardening, a number of bamboo sticks are binded by the stranded wires for building a bamboo fence. Further, a package or crating materials are binded by the stranded wires in packing operations of a big package or a heavy baggage.

Binding of the stranded wire is carried out in such steps of gripping a stranded wire binder 100, as shown in FIG. 10, and a turning portion of a stranded wire W in the shape of U-letter is hooked on a tip portion of the binder, as shown in FIG. 14. Then, the tip portion of the stranded wire binder 100 is hooked on portions of the stranded wire which are formed in twofold and the stranded wire binder 100 is swung about the tip portion thereof so as to entangle or engage the stranded wire W with the tip portion of the stranded wire binder 100 and then the stranded wire is released. Thereafter, as shown in FIG. 16, the stranded wire binder 100 is swung about the tip portion thereof so as to entwist the stranded wire W.

Therefore, efficiency of binding operations is very low and its bind sometimes become loose depending on operators so that reliability of bind goes down. Further, such a binding operation necessitates a skilled technique considerably and therefore it causes a physical fatigue.

SUMMARY OF THE INVENTION

In view of the above mentioned circumstances, the present invention has an object to provide a stranded wire binder which may entwist or strand a stranded wire efficiently and certainly with easy work.

To achieve the above object, the stranded wire binder according to the present invention comprises a bit rotates in engagement with a stranded wire, a motor, a transmission mechanism for operatively connecting the motor to the bit; said transmission mechanism being provided with a torque limiter and a position determining mechanism for controlling a stop position of the bit, and an operation mechanism for releasing a position determining function of the position determining mechanism.

In the present invention, after hooking the stranded wire on the tip portion of the bit and releasing a position determining function of the position determining mechanism by operating the operation mechanism, the motor is driven so that the bit rotates to entwist the stranded wire. With entwist of the stranded wire, a load acting on the bit increases gradually, but the entwist progresses to obtain almost an expected grade, the load reaches a constant value and as the result the torque limiter functions so that the motor races so that it may prevent the stranded wire from entwisting excessively.

As is clear from the above mentioned functions, the present invention has advantages as follows.

In the stranded wire binder according to the present invention, the stranded wire may be automatically entwisted only by engaging the stranded wire with the bit and rotating the bit by means of the motor. Therefore, the stranded wire may be binded with high efficiency and easy work without a skilled technique. Further, since the stranded wire binder is not swung with hands, it may easily bind the stranded wire effectively and as the result it may reduce a physical fatigue of the operator.

Further, since the torque limiter functions and twist of the stranded wire stops when a twist torque reaches a predetermined value, it may prevent the twist torque from varying or scattering depending upon the operators. As the result, the binding state does not become loose and it may keep the binding state firm. In the present invention, particularly, where the one-way clutch is interposed in the transmission mechanism, the bit rotates reversely due to resiliency of the stranded wire so that it may prevent an overload from acting on the torque limiter. As the result, it may prevent the torque limiter from breaking and also prevent the bit from escaping or rotating reversely when the stranded wire is engaged with the bit or after finishing its twist. Therefore, it is possible to bind the stranded wire with high efficiency.

Furthermore, particularly, the twist torque set by the torque limiter is determined by a diameter of the ball and a diameter of the round hole in the event that the torque limiter provides a rotary plate having ball receiving holes, a ball holding plate mounted rotatably and coaxially with respect to the rotary plate, balls held by the ball holding plate to be movable in directions of an axis of rotation and engaged or disengaged with the ball receiving holes, and spring means for urging the balls against the rotary plate, wherein each of the ball receiving holes comprises a round hole having a diameter smaller than the ball and a countersink continuing the round hole and having a diameter increasing as it is close to a surface of the rotary plate, so as to be larger than the ball at the surface of the rotary plate. It is possible to easily grade up precision of the sizes of the balls and the round holes so that dispersion or scattering of the sizes may be minimum to the extent that it may be disregarded. As the result, dispersion or scattering of the twist torque may be eliminated so that it may prevent an occurrence of dispersion of the binding states.

Further, the following functions and advantages may be obtained in the event that the position determining mechanism provides a rotary plate operatively rotatable with the bit. A groove formed with a periphery of the rotary plate, and a hook engaged and disengaged with the groove, and the operation mechanism comprises an operation lever mounted swingably about a pivot, a floating lever mounted swingably about a pivot, said hook being operatively connected to a free end of the floating lever, and spring means for urging the floating lever to an engaging position where the hook is engaged with the groove. A slider is provided with the torque limiter to move in directions of an axis of rotation at the time of transmitting a torque or limiting the torque. A pin lever pivoted to the operation lever is to swing operatively with the slider of the torque limiter, and a pin lever receiving portion is provided with the floating lever to engage and disengage with the pin lever, wherein the hook is disengaged with the groove via the pin lever and the floating lever by operating the operation lever in a direction of "ON", and the pin lever is disengaged with the pin receiving portion as the slider of the torque limiter moves from a position of torque transmition to a position of torque limitation so that the floating lever independent from the operation lever may be urged by means of spring means in a direction for engaging the hook with the groove.

Namely, the bit may be rotated by transmitting a torque of the motor to the bit by operating the operation lever in a direction of "ON", and the twist torque reaches a predetermined value of the torque limiter. The slider moves from a position of torque transmission to a position of torque limitation and in cooperation with this movement the lever pin is disengaged with the pin receiving portion so that the floating lever may be swung independently from the operation lever and then the hook may be urged against the periphery of the rotary plate by means of the spring via the floating lever which becomes independent. Accordingly, the bit operatively connected to the rotary plate takes a predetermined position and stops so that it may solve such a problem that it is difficult to hook the bit on the stranded wire due to unsteadiness of directions of the bit. After twisting of the stranded wire, the bit may easily come off the stranded wire by moving the bit in a direction opposite to the direction of insertion of the bit to the stranded wire so that operation efficiency may be more increased.

Furthermore, particularly, feeding of electricity may be carried out uselessly and saves consumption of electricity in the event that the stranded wire binder further comprises a switch for switching a feed of electricity to the motor, wherein by means of the operation mechanism the switch is turned on when the hook is disengaged with the groove and turned off when the hook is engaged with the groove. Accordingly, even if a battery, which is limited in the feeding time of electricity, is used as a power source, no change is necessary for the battery for a day or a few days.

Furthermore, particularly, the following advantages may be obtained in the event that the hook portion formed with the tip end of the bit comprises an inclined portion inclined to a side from a position remote away from a predetermined distance from the tip end thereof. A curved portion continues to the inclined portion is curved toward an axis of the bit, and a hook tip portion continues to the curved portion to extend from the axis of the bit in a direction opposite to the inclined portion and gently curved in a direction of a base of the bit, wherein a tip end side surface of the curved portion is continued smoothly to a tip end side curved surface of the hook tip portion for a predetermined distance from the axis of the bit, so as to be inclined at an angle within a range of 10 to 20 degrees with respect to an axis which crosses the axis of the bit with a right angle.

Namely, when the bit rotates, the stranded wire entangled with the hook tip portion does not escape from the curved portion to the inclined portion so that the stranded wire is entangled and entwisted with the hook tip portion at a portion from the axis of the bit to the hook tip portion. Accordingly, after twist of the stranded wire, the hook portion may easily be disengaged with the stranded wire and as the result operation efficiency may be increased greatly.

BRIEF DESCRIPTION OF THE DRAWINGS

The drawings show embodiments of a stranded wire binder according to the present invention:

FIG. 3 is a sectional view of an essential portion of a torque limiter for another embodiment, FIG. 4(*a*) is a graph showing characteristics of transmission torque of the torque limiter for another embodiment, FIG. 4(*b*) is a graph showing characteristics of twist torque of the torque limiter for another embodiment, FIG. 5 is a sectional view of an essential portion of the torque limiter used for the first embodiment, FIG. 6(i a) is a graph showing characteristics of transmission torque of the torque limiter for the first embodiment, FIG. 6(*b*) is a graph showing characteristics of twist torque of the torque limiter for the first embodiment.

DETAILED DESCRIPTION OF THE EMBODIMENTS

Figure 1:
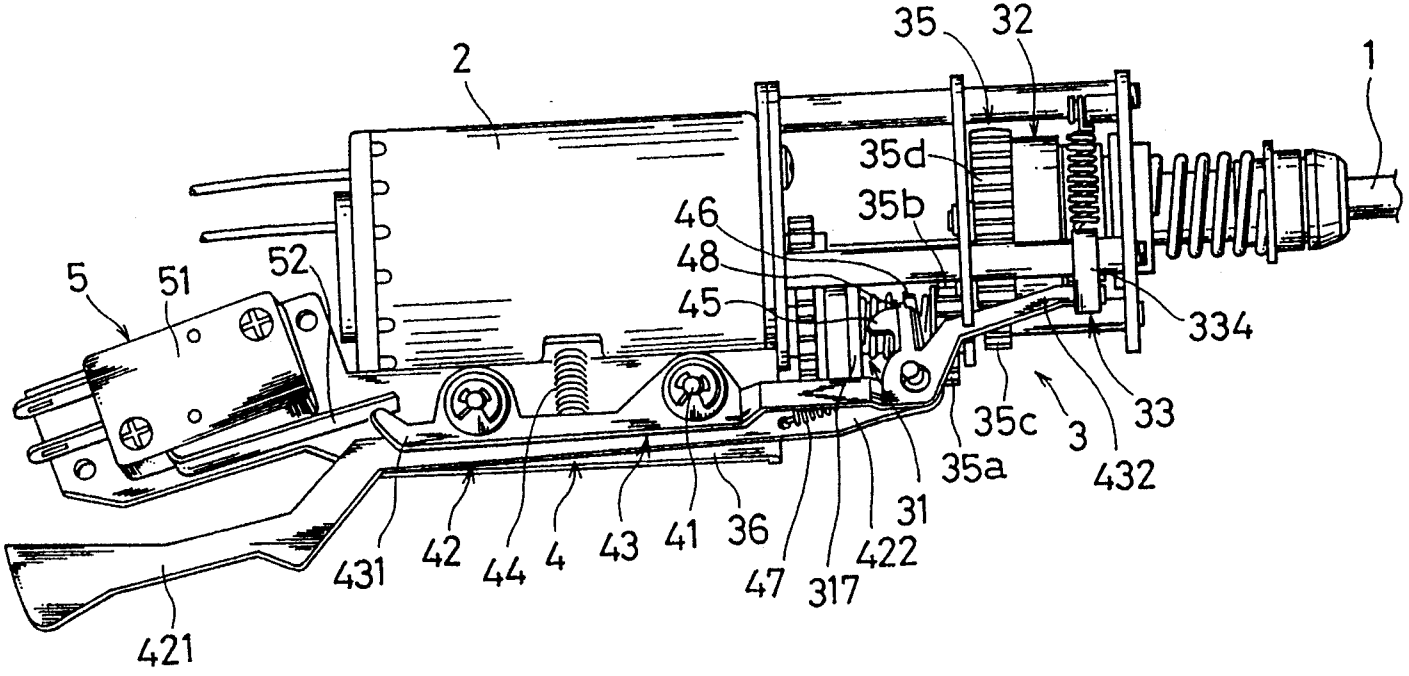
FIG. 1 is a side view of an essential portion of the stranded wire binder in the first embodiment, FIG. 2(*a*) is a perspective view of a torque limiter of the stranded wire binder disassembled, FIG. 2(*b*) is a sectional view of the torque limiter when transmiting a torque, FIG. 2(*c*) is a sectional view of the torque limiter when limiting a torque.

A stranded wire binder of the first embodiment of the present invention as shown in FIG. 1, comprises a bit 1 rotates in engagement with a stranded wire, a motor 2 and a transmission mechanism 3 for operatively connecting the motor 2 to the bit 1.

The transmission mechanism 3 provides a torque limiter 31, a one-way clutch 32, a position determining mechanism 33 for controlling a slop position of the bit 1, and an operation mechanism 4 for releasing a function of the position determining mechanism 33 for determining a position.

Figure 2A:
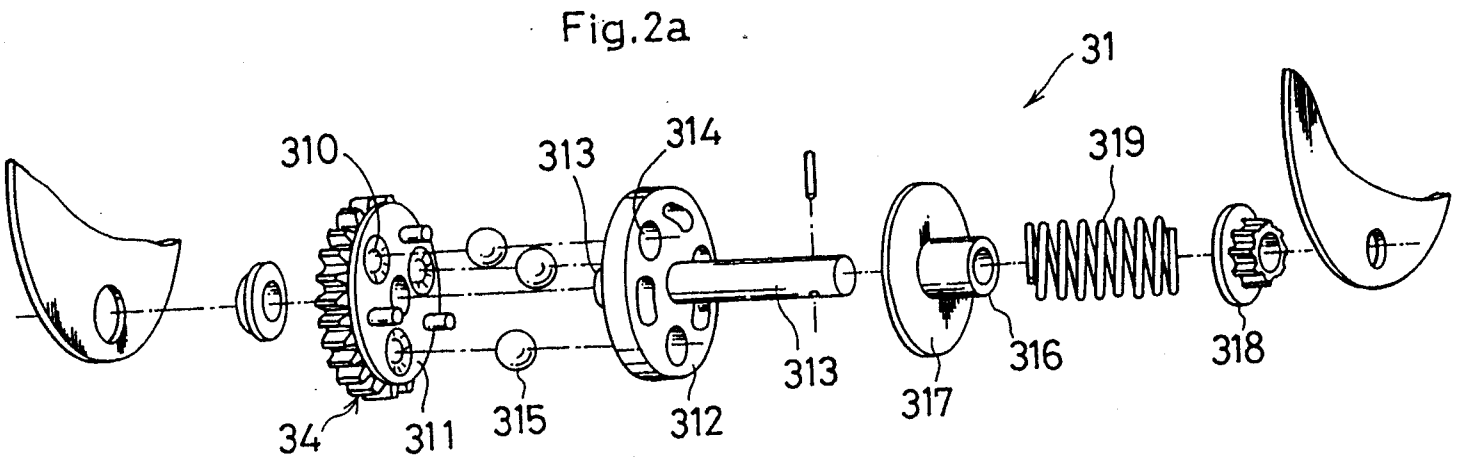
Figure 2C:
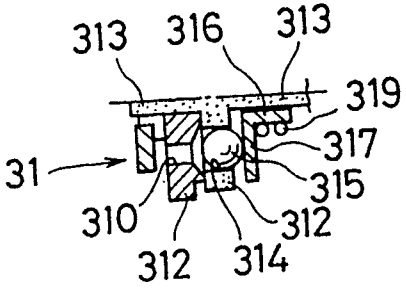
Figure 2B:
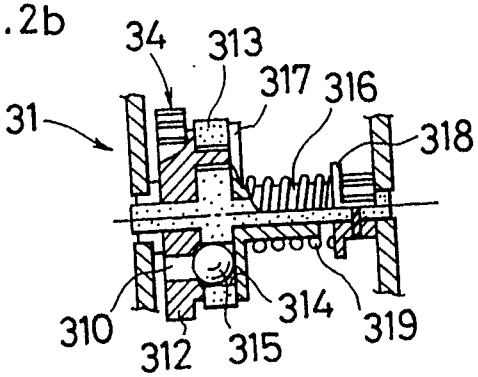

As shown in FIG. 2, the torque limiter 31 provides a rotary plate 311 which is operatively connected to the motor 2 via a reduction gear mechanism 34. Three ball receiving holes 310 are formed with the rotary plate 311 at positions which are remote from a rotational axis thereof for a predetermined distance and leaving a regular interval therebetween.

The torque limiter 31 provides a ball holding plate 312 in such a state that it is provided with the rotary plate 311 to be coaxialy rotatable with respect to the rotary plate 311. The ball holding plate 312 provides a center shaft 313 which extends in both directions along its rotational axis and also provides three ball holding holes 314 of round shape which are formed with three positions corresponding to the ball receiving holes 310. An end of the center shaft 313 is inserted rotatably into a center portion of the rotary plate 311.

The torque limiter 31 is inserted into the ball holding holes 314 of the ball holding plate 312 to be movable in directions of its rotational axis. Further, the torque limiter 31 provides three balls 315 which are engagable and disengagable with the ball receiving holes 310, a sleeve 316 which is put on the center shaft 313 slidably on an opposite side to the rotary plate 311 of the ball holding plate 312, an outer flange 317 which is connected to the sleeve 316 integrally and contacted with the balls 315.

The torque limiter 31 provides a spring receiver 318 which is fixed to an end portion of the center shaft 313 on an opposite side to the rotary plate 312, and a spring 319 which is received by the spring receiver 318 and urges the balls 315 against the rotary plate 311 via the outer flange 317.

The shape of each of the ball receiving holes 310 is not limited, but for instance the holes may be formed in a shape of an ordinary cone, as shown in FIG. 3.

In this case, the relationship between a transmission torque and an amount of movement of each of the balls 315 in an axial direction of the rotary plate 311 becomes proportional in such a state that as the amount of movement of each of the balls increases, the transmission torque increases proportionally, as shown in FIG. 4(*a*).

Further, as shown in FIG. 4(*b*), a twist torque for the stranded wire is determined depending on the transmission torque at a ratchet releasing point where the ball 315 rides on the surface of the rotary plate 311.

There arises a problem in this construction. Where the ball receiving holes are formed in such a conical shape, a dispersion tends to occur with the size of each of the ball receiving holes 310 in manufacturing the same, and as the result the dispersion brings about dispersion or scattering in the twist torque of the stranded wire.

Figure 6A:
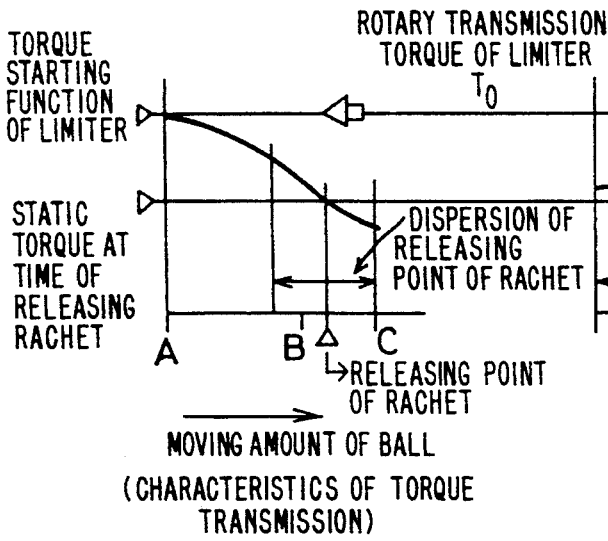
Figure 6B:
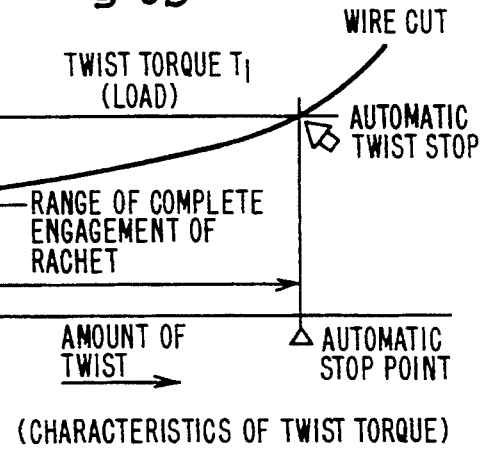

However, as shown in FIG. 5, each of the ball receiving holes 310 of the first embodiment comprises a round hole 310*a* having a diameter smaller than the ball 315, and a countersink 310*b* which continues to the round hole 310*a* and enlarges its diameter as it goes near the surface of the rotary plate 311, and has a diameter larger than the ball 315 at the surface of the rotary plate 311. When the ball receiving hole 310 is formed in such a shape, the transmission torque becomes maximum at the time of starting the movement of the ball 315, as shown in FIG. 6(*a*) and the twist torque is determined only by the transmission torque at the time of starting the movement of the ball 315. The transmission torque at the time of starting the movement of the ball 315, is determined by the diameter of the ball 315 and the diameter of the round hole 310*a* and therefore it may take no account of the dispersion of the twist torque in view of the fact that the dispersion with the sizes of the balls and ball receiving holes in manufacturing same may be almost disregarded.

As shown in FIG. 1, the one-way clutch 32 is operatively connected to the ball holding plate 312 of the torque limiter 31 via another reduction gear mechanism 35. The reduction gear mechanism 35 comprises a small gear 35*a* which is fixed to another end of the center shaft 314 of the torque limiter 31, an intermediate big gear 35*b* engagable with the small gear 35*b*, an intermediate small gear 35*c* coaxial with the intermediate o big gear 35*b*, and a big gear 35*d* engagable with the intermediate small gear 35*c*.

Figure 7:
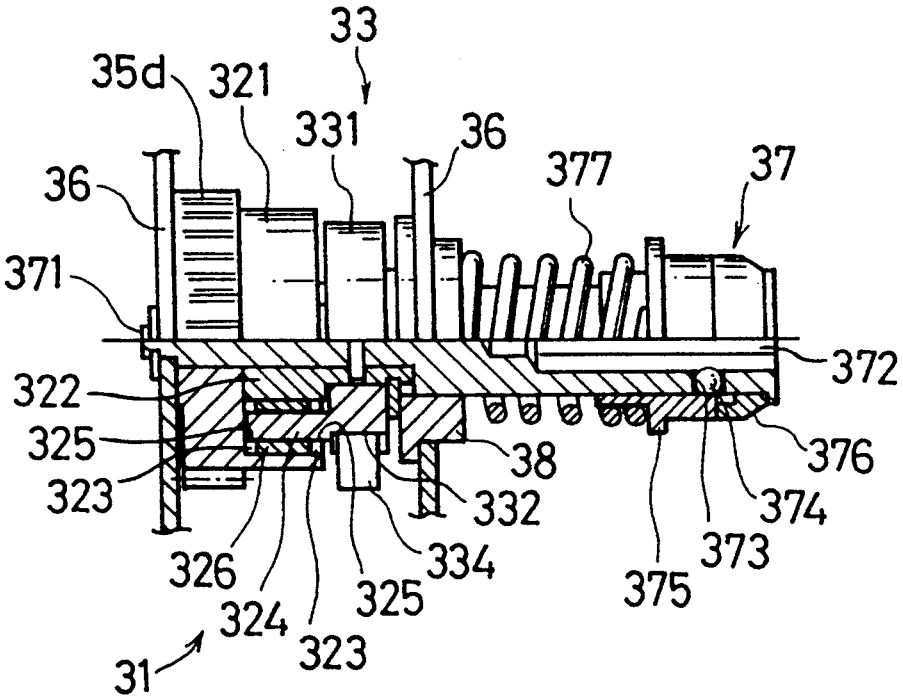
FIG. 7 is a side view of a one-way clutch, a position determining mechanism and a chuck device, partly broken away, used for the first embodiment of the stranded wire binder, FIG. 8(*a*) is perspective views of the one-way clutch, the position determining mechanism and the chuck device disassembled, used for the first embodiment of the stranded wire binder, FIG. 8(*b*) is a sectional view of the one-way clutch when transmitting a torque, FIG. 8(*c*) a sectional view of the one-way clutch when cutting the transmission of a torque, FIG. 9(*a*) is a front view of the position determining mechanism when determining a position, FIG. 9(*b*) is a front view of the position determining mechanism when releasing a function of determining a position, FIG. 10 side view of a bit used for the first embodiment of the stranded wire binder, FIG. 11(*a*) a side view of a pin-lever used for the stranded wire binder of the first embodiment when it is in the state of engagement, FIG. 11(*b*) is a side view of the pin-lever when it is in the state of disengagement, FIG. 12(*a*) is a sectional bottom view of an operation mechanism used for the stranded wire binder of the first embodiment, FIG. 12(*b*) is a perspective view of the operation mechanism disassembled.
Figure 8A:
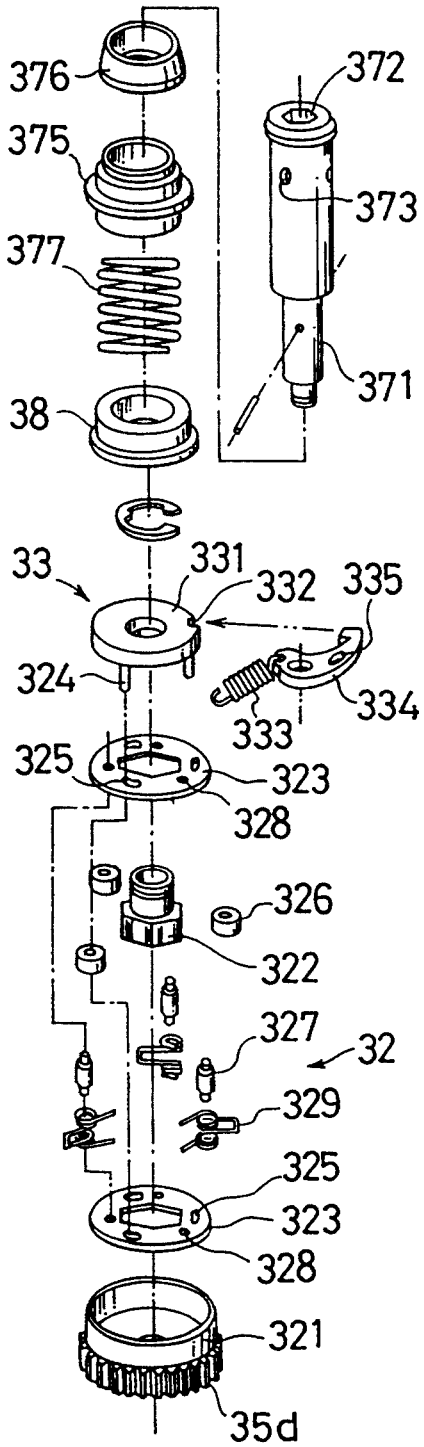
Figure 8B:
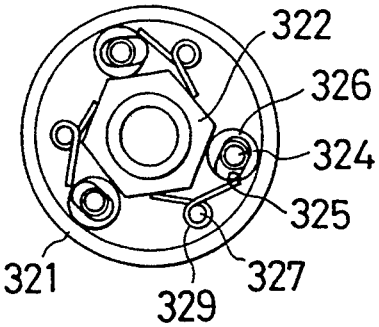
Figure 8C:
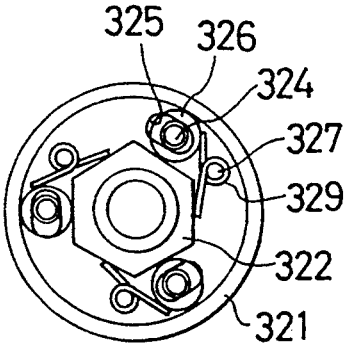

As shown in FIGS. 7 and 8, the one-way clutch 32 provides a peripheral ring 321 which is formed in integral with the big gear 35*d* of the reduction gear mechanism 35, and a hexagonal shaft 322 which is inserted into an interior of the peripheral ring 321 to be rotatable in coaxial with the peripheral ring.

A pair of roller holding plates 323 are fixed to the hexagonal shaft 322, leaving a suitable distance therebetween in its axial direction. Three arc slots 325 are formed with both of the roller holding plates 323, leaving a regular interval in a direction of the periphery thereof. Three roller shafts 324 are inserted into the three slots 325 in such a state that both ends of the shafts are movable in parallel with one another in a direction of the periphery thereof. A clutch roller 326 is put on each of the roller shafts 324 inserted into each of the arc slots 325 rotatably. The clutch roller 326 is designed to have a diamter smaller than the maximum clearance between the peripheral ring 321 and the hexagonal shaft 322, but larger than the minimum clearance thereof. A round opening 328 is formed with the roller holding plates 323 at positions between the arc slots 325. Both of the ends of a spring support shaft 327 is inserted into each of the round openings 328, respectively. Each of the clutch rollers 326 is urged against the hexagonal shaft 322 independently by means of a helical spring 329 which is held by the roller holding plate 323 via the spring support shaft 327.

Figure 9A:
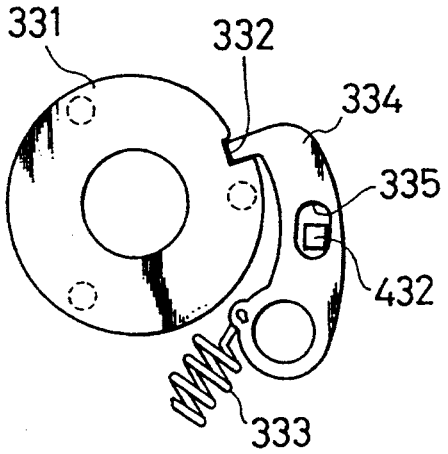
Figure 9B:
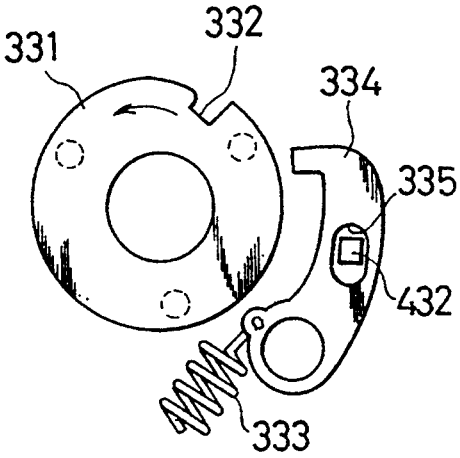

The position determining mechanism 33 provides a rotary plate 331 which is mounted on the hexagonal shaft 322 of the one-way clutch 32 to be swingable within a predetermined range. The rotary plate 331 is formed integral with each of the roller shafts 324 of the one-way clutch 32, as shown in FIG. 7, FIG. 8(*a*) or FIG. 9. A position determining groove 332 is formed with the periphery of the rotary plate 331.

The position determining mechanism 33 is supported swingably by a frame 36 of the transmission mechanism 3 which is shown in FIG. 1. The position determining mechanism 33 provides a hook 334 which is urged against the periphery of the rotary plate 331 by means of a spring 333.

As shown in FIG. 7, a center shaft 371 of a chuck device 37 penetrates the peripheral ring 321 of the one-way clutch 32, the hexagonal shaft 322 and the rotary plate 331 of the position determining mechanism 33. The center shaft 371 is inserted into the peripheral ring 321 rotatably and fixed to the hexagonal shaft 322 by means of a pin. An end of the center shaft 371 is inserted into the frame 36 of the transmission mechanism 3 rotatably and an intermediate portion of the center shaft is supported rotatably by the frame 36 of the transmission mechanism 3 via a bush 38.

Figure 10:
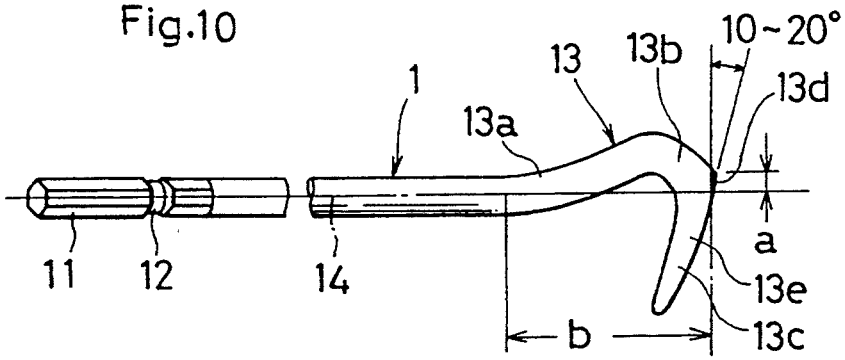

A hexagonal hole 372 is formed with the other end of the center shaft 371 and a hexagonal shaft 11, FIG. 10, is formed with a base portion of the bit 1 to correspond to the hexagonal hole 372. Therefore, it is possible to change an angle of attachment of the bit 1 every 60 degrees when the hexagonal shaft 11 is inserted in to the hexagonal hole 372.

As shown in FIG. 7 or FIG. 8, a ball holding opening 373 is formed with the other end of the center shaft 371 to communicate with the hexagonal hole 372. As shown in FIG. 10, a peripheral groove 12 is formed with an intermediate portion of the hexagonal shaft 11, which is, namely, corresponding to the ball holding opening 373 of the bit 1.

Further, A position determining ball 374 is movably inserted into the ball holding opening 373 and a sleeve 375 is put on the center shaft 371 slidably. When the sleeve 375 is moved to a chuck position on the side of an end, the sleeve 375 covers the ball holding opening 373 so that the ball 374 may be pressed by the sleeve 375 and a part of the ball 374 may be inserted into the peripheral groove 12 of the hexagonal shaft 11 which is inserted into the hexagonal hole 372. When the sleeve 375 is moved to an unchucked position to the other end, the sleeve 375 opens the ball holding opening 373 so that the ball 374 may freely return into the ball holding opening 373.

A cap 376 is put on the forward end of the center shaft 371 and fixed. The cap 376 receives the other end of the sleeve 375 so that it may prevent the sleeve 375 from progressing toward the other end beyond the chuck portion. The sleeve 375 is urged into the chuck position by means of a spring 377.

Figure 12A:
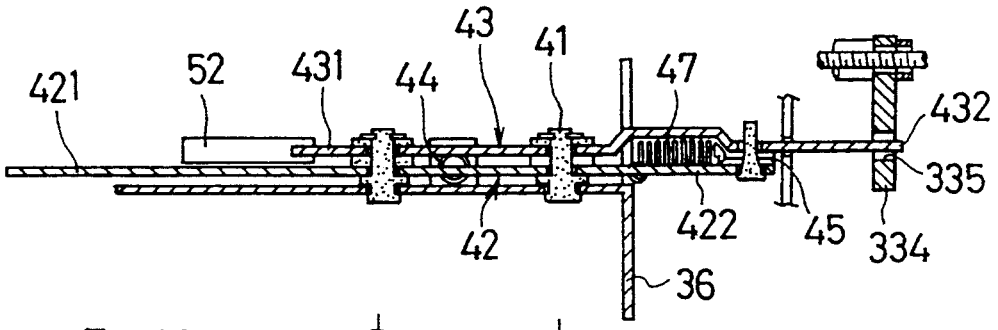
Figure 12B:
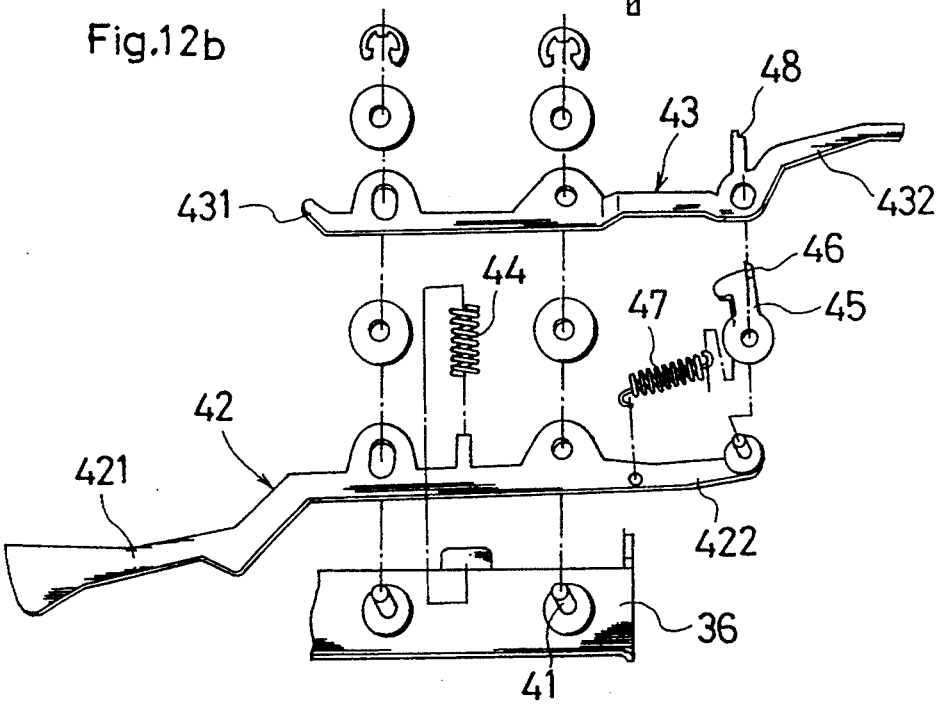

As shown in FIGS. 1 and 12, the operation mechanism 4 provides an operation lever 42 which is mounted swingably about a pivot pin 41 which is fixed to the frame 36, and a floating lever 43.

The operation lever 42 provides an operation arm 421 which extends outwardly of an end of the motor 2 from the pivot pin 41, and a function arm 422 which extends from the pivot pin 41 to the other end of the motor 2 adjacent the torque limiter 31. A pin lever 45 is pivoted at a forward end of the function arm 422, to be driven swingably by means of the outer flange 317 of the torque limiter 31. A pin 46 is provided with the free end of the pin lever 45 to project toward the floating lever 43. The free end of the pin lever 45 is urged against the outer flange 317 by means of a spring 47 which is mounted to bridge the free end and the operation lever 42.

The floating lever 43 provides a switch operation arm 431 which extends outwardly of an end of the motor 2 from the pivot pin 41, and a function arm 432 which extends toward the position determining mechanism 33 from the pivot pin 41. A forward end of the function arm 432 is inserted into an engaging opening 335 which is formed with the hook 334 of the position determining mechanism 33.

The floating lever 43 is operated to urge the hook 334 against the periphery of the rotary plate 331, by means of a spring 44 which is interposed between an intermediate portion of the switch operation arm 431 and the frame 36. A pin receiving portion 48 is provided with the floating lever 43 so as to receive the pin 46 of the pin lever 45 when the operation lever 42 is operated in a direction of "ON", i.e. engagement.

Figure 11A:
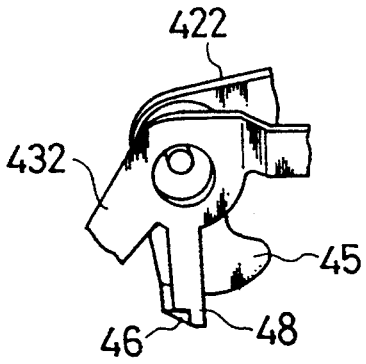
Figure 11B:
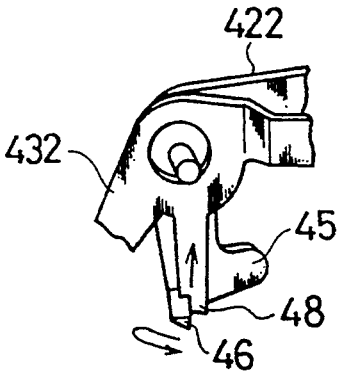

As shown in FIG. 11(*a*), when the operation lever 42 is swung in a direction of operation in such a state that the pin 46 of the pin lever 45 is received by the pin receiving portion 48, the floating lever 43 is swung about the pin 46 in a direction that the hook 334 is disengaged with the groove 332, and as the result the hook 334 comes off the groove 332. Then, the pin lever 46 is disengaged with the pin receiving portion 48, as shown in FIG. 11(*b*), by such an operation that the outer flange 317 of the torque limiter 31 moves from a position of torque transmission to a position of torque limitation. As the result, the hook 334 is urged against the periphery of the rotary plate 331 by means of the spring 44 via the floating lever 43 which becomes independent from the operation lever 42, so that the hook 334 may be inserted into and engaged with the groove 332 when the rotary plate 331 turns with a predetermined phase of rotation, and then the position of the rotary plate 331 is determined. With determination of the position of the rotary plate 331, it may determine the stop position of the bit 1 which is fixed to the rotary plate 331 via the chuck device 37.

As shown in FIG. 1, an end of the frame 36 extends outwardly of an end of the motor 2 and a switch 5 is provided with the extended end of the frame 36 for switching feed of electricity for the motor 2. The switch 5 provides a package 51 and an operation lever 52 introduced therefrom, and when the operation lever 41 of the operation mechanism 4 is operated in a direction of "ON", the switch operation arm 431 of the floating lever 42, which is operably connected to the operation lever 41, presses the operation arm 52 of the switch 5 so as to turn on the switch 5. Further, it is constructed such that the switch 5 turns off since the operation lever 52 of the switch 5 is released, when the pin lever 45 is disengaged with the floating lever 43 while the operation lever 41 is pressed in a direction of "ON", and then the floating lever 42 is urged by means of the spring 44 so that the hook 334 is inserted into and engaged with the groove 332 of the rotary plate 331.

As shown in FIG. 10, a hook portion 13 is formed with a forward end of the bit 1. The hook portion 13 provides an inclined portion 13*a* which is inclined in a direction from a position remote away from the forward end thereof for a predetermined distance, a curved portion 13*b* which follows the inclined portion 13*a* and is curved toward the axis 14 of the bit 1, and a hook tip portion 13*c* which extends in a direction opposite to the inclined portion 13*a* from the axis 14 of the bit 1 and curved gently in a direction of the base of the bit 1. A tip end side surface 13*d* of the curved portion 13*b* for a predetermined distance a from the axis 14 of the bit 1, smoothly continues to a tip end side surface 13*e* of the hook tip portion 13*c* and is then inclined with an angle of 15 degrees with respect to an axis which crosses the axis 14 of the bit 1 with a right angle. The angle may be set within a range of about 10 to 20 degrees.

Figure 13:
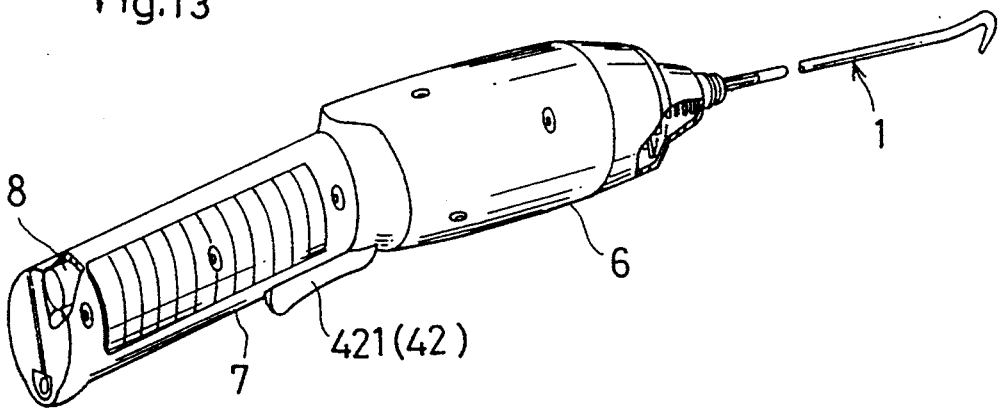
FIG. 13 is a perspective view of an appearance of the stranded wire binder of the first embodiment.

As shown in FIG. 13, the frame 36, the motor 2, the transmission mechanism 3 and the operation mechanism 4 are housed in a main case 6 except an end portion of each of the operation lever 41 of the operation mechanism 4 and the frame 36. These end portions of the operation lever 41 of the operation mechanism 4 and the frame 36 are housed in a grip case 7 which is provided with an end of the main case 6. The grip case 7 also houses therein the switch 5, a battery 8 as a power source and circuits therefor.

Next, the manner for operating the stranded, wire binder of the above mentioned embodiment will be described below.

Figure 14:
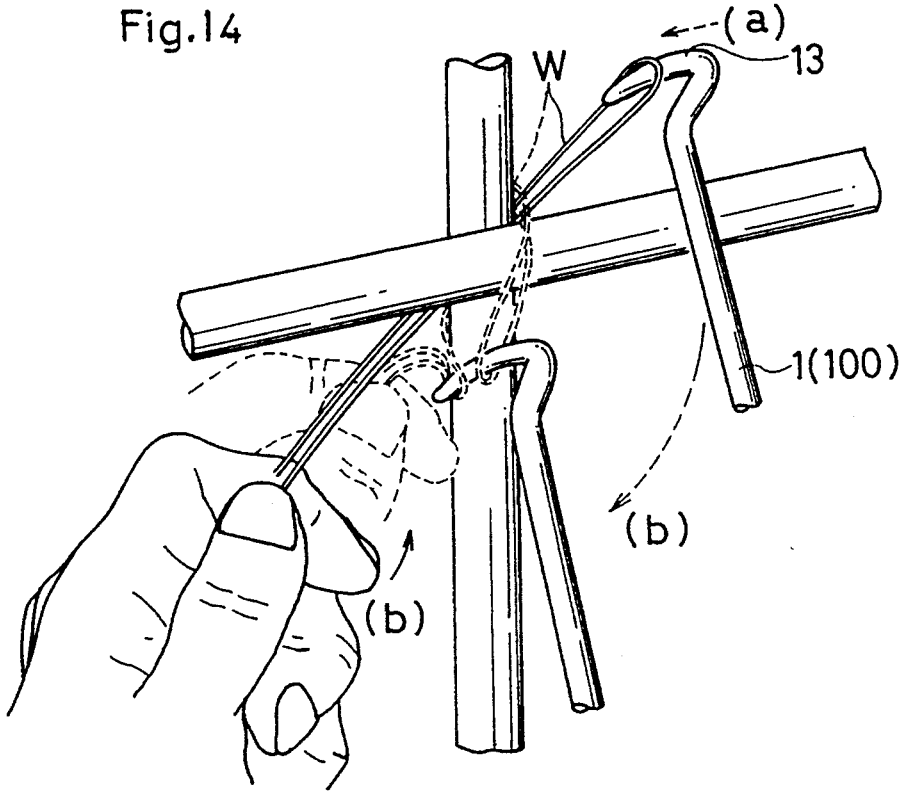
FIG. 14 is a perspective view showing a manner of twisting a stranded wire with the bit.

First, the grip case 7 of the stranded wire binder is gripped with a hand and then the following steps are taken as shown in FIG. 14.

As indicated with (a), a turning portion of the stranded wire W in the shape of U-letter is hooked on the hook portion 13 of the bit 1.

As indicated with (b), while the end of the stranded wire is held with the other hand, the hook portion 13 of the bit 1 is hooked on the portions of the stranded wire which form dual wires and then the stranded wire binder is twisted one rotation with the hand so as to twist or entangle the stranded wire with the hook portion 13 of the bit 1.

Thereafter, the stranded wire is released from the hand and then the operation arm 41*a* of the operation lever 41 is gripped so that the switch may turn on to start the motor 2. As the result, the hook 334 of the position determining mechanism 33 comes off the groove 332 so as to release its position determining function and as indicated with (a) in FIG. 15, the bit 1 turns about the axis 14 so as to entwist the stranded wire W. In the situation, since the tip end side surface 13*d* of the curved portion 13*b* for the predetermined distance a from the axis 14 of the bit 1 smoothly continues to the curved tip end side surface 13*e* of the hook tip portion 13*c* and is inclined with an angle of 15 degrees with respect to an axis which crosses the axis 14 of the bit 1 with a right angle, the stranded wire W is entwisted effectively in such a state that the stranded wire W does not escape toward the curved portion 13*b*.

Figure 15:
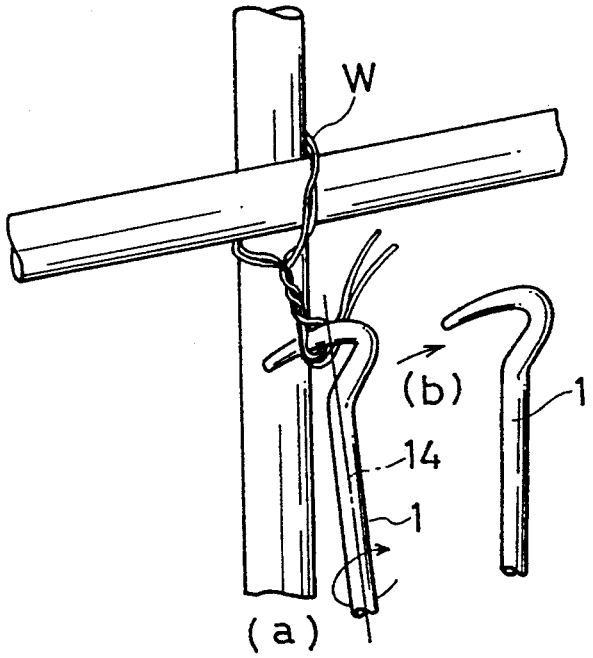
FIG. 15 is perspective view showing a manner of twisting a strand of the stranded wire by means of the stranded wire binder of the first embodiment and FIG. 16 is a perspective view showing a manner of twisting a strand of the stranded wire by means of a stranded wire binder of prior art.
Figure 16:
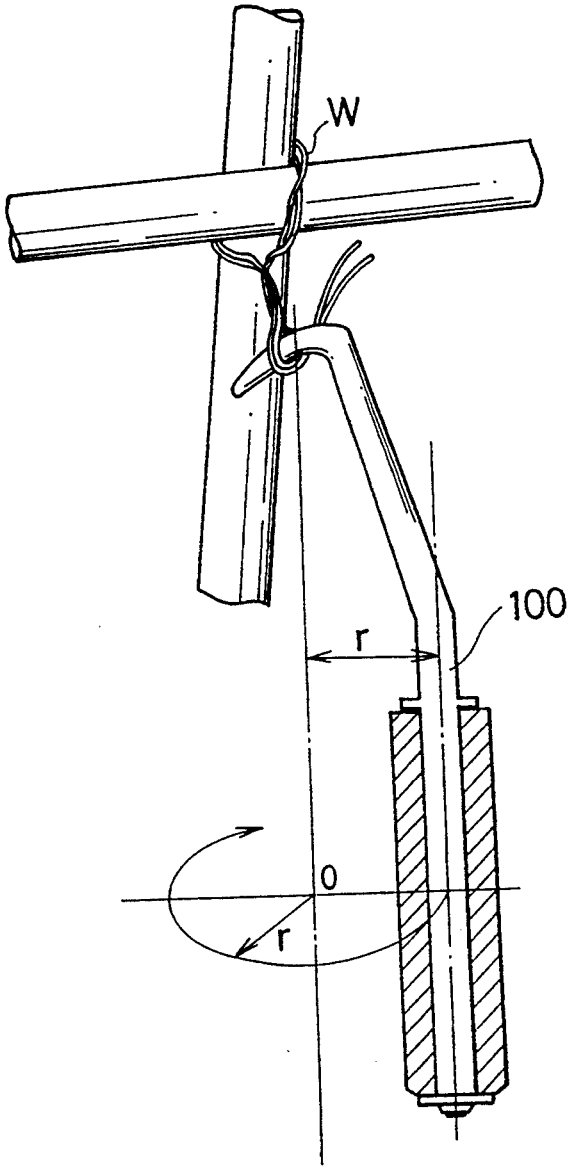
Fig. 16 PRIOR ART

When the stranded wire W is entwisted, the twist torque gradually becomes large and as it reaches a predetermined value, the torque limiter 31 functions to limit the torque transmitted to the bit 1, so as to stop entwisting of the stranded wire W and the motor begins to race. At the time of limiting the torque by means of the torque limiter 31, the outer flange 317 of the torque limiter 31 simultaneously drives the pin lever 45 to disengage the pin lever 45 with the floating lever 42. When the bit 1 reaches a predetermined phase of rotation, the hook 334 is put into the groove 332 by means of the spring 44 via the floating lever 42 so that the position determining mechanism 33 restores its position determining function. Namely, the bit 1 automatically stops when twist of the stranded wire W reaches a predetermined level and also stops in such a state that the bit 1 faces the same direction wherein the stranded wire W is hooked on the hook portion 13. Therefore, as shown in FIG. 15(*b*), the bit 1 may be disengaged with the stranded wire W by withdrawing the bit 1 in the same direction wherein the hook portion 13*a* of the bit 1 is inserted, and as the result, its operative efficiency may be increased greatly.

What is claimed is:

1. A stranded wire binder comprising:

a bit that rotates in engagement with a stranded wire, a motor, a transmission mechanism for operatively connecting the motor to the bit, said transmission mechanism being provided with a torque limiter and a position determining mechanism for controlling a stop position of the bit, an operation mechanism for releasing a position determining function of the position determining mechanism, a rotary plate having ball receiving holes, a ball holding plate mounted rotatably and coaxially with respect to the rotary plate, balls held by the ball holding plate which are movable in directions of an axis of rotation and engaged or disengaged with the ball receiving holes, and spring means for urging the balls against the rotary plate, wherein each of the ball receiving holes comprises a round hole having a diameter smaller than the ball and a countersink continuing the round hole and having a diameter that increases as the round hole becomes close to a surface of the rotary plate, so as to be larger than the ball at the surface of the rotary plate.

2. The stranded wire binder as claimed in claim 1 wherein:

the position determining mechanism comprises:

a rotary plate operatively rotatable with the bit, a groove formed with a periphery of the rotary plate, and a hook engaged and disengaged with the groove, and the operation mechanism comprises:

an operation lever mounted swingably about a pivot, a floating lever mounted swingably about a pivot, said hook being operatively connected to a free end of the floating lever, spring means for urging the floating lever to an engaging position where the hook is engaged with the groove, a slider provided with the torque limiter to move in directions of an axis of rotation at the time of transmitting a torque or limiting the torque, a pin lever pivoted to the operation lever to swing operatively with the slider of the torque limiter, and a pin lever receiving portion provided with the floating lever to engage and disengage with the pin lever, wherein:

the hook is disengaged with the groove via the pin lever and the floating lever by operating the operation lever in a direction of "ON", and the pin lever is disengaged with the pin receiving portion as the slider of the torque limiter moves from a position of torque transmition to a position of torque limitation so that the floating lever independent from the operation lever may be urged by means of spring means in a direction for engaging the hook with the groove.

3. The stranded wire binder as claimed in claim 1, further comprising:

a switch for switching feed of electricity to the motor, wherein by means of the operation mechanism the switch is turned on when hook a disengaged with a groove and turned off when the hook is engaged with the groove.

4. The stranded wire binder as claimed in claim 1, wherein the hook portion formed with the tip end of the bit comprises:

an inclined portion inclined to a side from a position remote away from a predetermined distance from the tip end thereof, a curved portion continued to the inclined portion and curved toward an axis of the bit, and a hook tip portion continued to the curved portion to extend from the axis of the bit in a direction opposite to the inclined portion and gently curved in a direction of a base of the bit, wherein:

a tip end side surface of the curved portion is continued smoothly to a tip end side curved surface of the hook tip portion for a predetermined distance from the axis of the bit, so as to be inclined at an angle within a range of 10 to 20 degrees with respect to an axis which crosses the axis of the bit with a right angle.

5. A stranded wire binder comprising:

a bit rotating in engagement with a stranded wire, a motor, a transmission mechanism for operatively connecting the motor to the bit, said transmission mechanism being provided with a one-way clutch, a torque limiter and a position determining mechanism for controlling a stop position of the bit, and an operation mechanism for releasing a position determining function of the position determining mechanism, said torque limiter including a rotary plate having ball receiving holes, a ball holding plate mounted rotatably and coaxially with respect to the rotary plate, balls held by the ball holding plate which are movable in directions of an axis of rotation and engaged or disengaged with the ball receiving holes, and spring means for urging the balls against the rotary plate, wherein each of the ball receiving holes comprises a round hole having a diameter smaller than the ball and a countersink continuing the round hole and having a diameter that increases as the round hole becomes close to a surface of the rotary plate, so as to be larger than the ball at the surface of the rotary plate.

6. The stranded wire binder as claimed in claim 5, further comprising:

a switch for switching feed of electricity to the motor, wherein by means of the operation mechanism the switch is turned on when a hook is disengaged with a groove and turned off when the hook is engaged with the groove.

7. The stranded wire binder as claimed in claim 5, wherein a hook portion formed with a tip end of the bit comprises:

an inclined portion inclined to a side from a position remote away from a predetermined distance from the tip end thereof, a curved portion that continues to the inclined portion and curved toward an axis of the bit, and a hook tip portion that continues to the curved portion to extend from the axis of the bit in a direction opposite to the inclined portion and gently curved in a direction of a base of the bit, wherein:

a tip end side surface of the curved portion continues smoothly to a tip end side curved surface of the hook tip portion for a predetermined distance from the axis of the bit, so as to be inclined at an angle within a range of 10 to 20 degrees with respect to an axis which crosses the axis of the bit with a right angle.

8. A stranded wire binder comprising:

a bit rotating in engagement with a stranded wire, a motor, a transmission mechanism for operatively connecting the motor to the bit, said transmission mechanism being provided with a torque limiter and a position determining mechanism for controlling a stop position of the bit, and an operation mechanism for releasing a position determining function of the position determining mechanism, the position determining mechanism comprises:

a rotary plate operatively rotatable with the bit, a groove formed with a periphery of the rotary plate, and a hook engaged and disengaged with the groove, and the operation mechanism comprises:

an operation lever mounted swingably about a pivot, a floating lever mounted swingably about a pivot, said hook being operatively connected to a free end of the floating lever, spring means for urging the floating lever to an engaging position where the hook is engaged with the groove, a slider provided with the torque limiter to move in directions of an axis of rotation at the time of transmitting a torque or limiting the torque, a pin lever pivoted to the operation lever that swings operatively with the slider of the torque limiter, and a pin lever receiving portion provided with the floating lever to engage and disengage with the pin lever, wherein:

the hook is disengaged with the groove via the pin lever and the floating lever by operating the operation lever in a direction of "ON", and the pin lever is disengaged with the pin receiving portion as the slider of the torque limiter moves from a position of torque transmission to a position of torque limitation so that the floating lever independent from the operation lever may be urged by means of spring means in a direction for engaging the hook with the groove.

9. The stranded wire binder as claimed in claim 8 wherein a hook portion formed with a tip end of the bit comprises:

an inclined portion inclined to a side from a position remote away from a predetermined distance from the tip end thereof, a curved portion that continues to the inclined portion and curved toward an axis of the bit, and a hook tip portion that continues to the curved portion to extend from the axis of the bit in a direction opposite to the inclined portion and gently curved in a direction of a base of the bit, wherein:

a tip end side surface of the curved portion continues smoothly to a tip end side curved surface of the hook tip portion for a predetermined distance from the axis of the bit, so as to be inclined at an angle within a range of 10 to 20 degrees with respect to an axis which crosses the axis of the bit with a right angle.

10. The stranded wire binder as claimed in claim 8, wherein the transmission mechanism comprises a one-way clutch.

11. A stranded wire binder comprising:

a bit rotating in engagement with a stranded wire, a motor, a transmission mechanism for operatively connecting the motor to the bit, said transmission mechanism being provided with a torque limiter and a position determining mechanism for controlling a stop position of the bit, an operation mechanism for releasing a position determining function of the position determining mechanism, and a switch for switching feed of electricity to the motor, wherein by means of the operation mechanism the switch is turned on when a hook is disengaged with a groove and turned off when the hook is engaged with the groove.

12. The stranded wire binder as claimed in claim 11 wherein the transmission mechanism comprises a one-way clutch.

13. A stranded wire binder comprising:

a bit rotating in engagement with a stranded wire, a motor, a transmission mechanism for operatively connecting the motor to the bit, said transmission mechanism being provided with a torque limiter and a position determining mechanism for controlling a stop position of the bit, an operation mechanism for releasing a position determining function of the position determining mechanism, a hook portion formed with the tip end of the bit comprises:

an inclined portion inclined to a side from a position remote from a predetermined distance from the tip end thereof, a curved portion that continues to the inclined portion and curved toward an axis of the bit, and a hook tip portion that continues to the curved portion to extend from the axis of the bit in a direction opposite to the inclined portion and gently curved in a direction of a base of the bit wherein:

a tip end side surface of the curved portion continues smoothly to a tip end side curved surface of the hook tip portion for a predetermined distance from the axis of the bit, so as to be inclined at an angle within a range of 10 to 20 degrees with respect to an axis which crosses the axis of the bit with a right angle.

14. The stranded wire binder as claimed in claim 13 wherein the transmission mechanism comprises a one-way clutch.

* * * * *